US006527129B2

(12) United States Patent
Osawa

(10) Patent No.: US 6,527,129 B2
(45) Date of Patent: Mar. 4, 2003

(54) COMMODITY DISPLAY BOARD

(75) Inventor: Shinichi Osawa, Tokyo (JP)

(73) Assignee: Kawajun Co., Ltd., Tokyo (JP)

( * ) Notice: Subject to any disclaimer, the term of this patent is extended or adjusted under 35 U.S.C. 154(b) by 0 days.

(21) Appl. No.: 09/866,694

(22) Filed: May 30, 2001

(65) Prior Publication Data

US 2002/0179556 A1 Dec. 5, 2002

(51) Int. Cl.[7] ..... A47F 5/00
(52) U.S. Cl. ..... 211/184
(58) Field of Search ..... 211/184, 43, 11, 211/10; 108/60, 61

(56) References Cited

U.S. PATENT DOCUMENTS 3,497,081 A * 2/1970 Field et al. ..... 211/184
3,954,184 A * 5/1976 Mendenhall ..... 211/184
4,768,661 A * 9/1988 Pfeifer ..... 211/184
4,941,784 A * 7/1990 Flament ..... 211/184
4,942,968 A * 7/1990 Fast ..... 108/61
5,255,802 A * 10/1993 Krinke et al. ..... 211/184
5,441,709 A * 8/1995 Berry, Jr. ..... 206/370
5,971,826 A * 10/1999 Delzompo et al. ..... 211/184
6,244,447 B1 * 6/2001 Frieze et al. ..... 206/370
6,364,130 B2 * 4/2002 Wright ..... 211/184

* cited by examiner

*Primary Examiner*—Alvin Chin-Shue
*Assistant Examiner*—Sarah Purol
(74) *Attorney, Agent, or Firm*—Oblon, Spivak, McClelland, Maier & Neustadt, P.C.

(57) ABSTRACT

A commodity display board including a rectangular, flat board main body having a predetermined surface area necessary to display commodities. Many slit-like engagement holes each having a predetermined length are formed on an entire top surface of the board main body in a matrix at predetermined intervals in longitudinal and lateral directions of the board.

2 Claims, 14 Drawing Sheets

COMMODITY DISPLAY BOARD

TECHNICAL FIELD OF THE INVENTION

The present invention relates to a commodity display board used when displaying commodities such as vegetables and fruits on a cooling case, a wagon or the like. More particularly, the present invention relates to a commodity display board which can be used as a base plate (or grating), a backplate, an inclined plate or the like to display commodities and with which display equipment such as rolling stoppers and partitions can be assembled.

BACKGROUND ART

In displaying round commodities such as oranges and apples, long commodities such as green onions and burdocks, leaf and stem commodities such as spinaches and leaf lettuces on a vegetable and fruit cooling case, a wagon or the like in a supermarket or the like, a base plate (or shelf plate) is attached to a display frame constituting the cooling case, the wagon or the like and commodities are put on the base plate to thereby display the commodities, a partition plate is provided on a base plate to thereby display the commodities in order on the base plate according to types, or a base plate itself is obliquely attached to a frame or a volume-up member called a filling is disposed on a base plate and leaf and stem commodities are displayed to be rested so as to add volume to displayed commodities and to make commodities appear attractive. By doing so, commodities are displayed beautifully and effectively to grow the buying power of consumers.

However, the base plate used for conventional commodity display is formed to have a dedicated shape and a dedicated size to conform to the display frame constituting the cooling case, the wagon or the like. Due to this, if the display frame is changed in shape or different frames are used, it is required to prepare various types of base plates different in shape and size accordingly, thereby disadvantageously pushing up cost. Furthermore, the base plate for the conventional commodity display is provided on the premise that commodities are put on and displayed the base plate. Due to this, the form of the base plate to be used is disadvantageously limited. For example, it is impossible to arrange the base plate vertically, to attach a commodity mounting plate in front of the base plate to thereby mount and display commodities thereon or to arrange the base plate obliquely to display commodities such as oranges by stages, thus lacking in flexibility.

DISCLOSURE

The present invention has been made to solve the above-stated disadvantages. It is, therefore, an object of the present invention to provide a commodity display board which can be applied to various forms to be used according to the manner in which commodities are displayed, into which display equipment such as rolling stoppers, partitions and the like can be assembled, on which less dust remains and which is good in air permeability.

To obtain the above object, the present invention is a commodity display board for displaying commodities, characterized by comprising a flat board main body having a predetermined surface area necessary to display the commodities, and characterized in that many engagement holes for attaching display equipment and permeating air are formed on an entire region of a top surface of the board main body at predetermined intervals.

Also, the present invention is characterized in that the engagement holes are slits each having a predetermined length, and the slit-like engagement holes are arranged in a matrix on the top surface of the board main body.

Further, the present invention is characterized in that the engagement holes are formed out of slit-like grooves extending over the enter length of one edge of the board main body, and the slit-like grooves are arranged parallel to one another in large number at predetermined intervals in a direction of the other edge of the board main body.

Furthermore, the present invention is characterized in that the slit-like engagement holes are penetrated into a rear surface of the board main body, and the slit-like engagement holes are formed to be gradually enlarged from the top surface of the board main body toward the rear surface of the board main body.

Moreover, the present invention is characterized in that a width of each of the slit-like grooves is gradually increased from the top surface of the board main body toward the rear surface of the board main body, and a bottom of each of the slit-like grooves is opened to the rear surface while being partially left.

Furthermore, the present invention is characterized in that the display equipment are rolling stopper plates, partition plates, and mounting plates for the commodities displayed on the board main body, the display equipment are held to the board main body by being engaged with the engagement holes, respectively, and constituted to be able to partition the top surface of the board main body into a plurality of regions in accordance with the displayed commodities.

Additionally, the present invention is characterized in that a rib guiding the display equipment is formed on one of an inner wall surface of each of the slit-like engagement holes and an inner wall surface of each of the slit-like grooves.

Further, the present invention is characterized in that coupling mechanisms coupling the adjacent board main bodies to each other are provided at least longitudinal or lateral both ends of the board main bodies so that the top surfaces of the adjacent board main bodies are coincident with each other.

According to the present invention, the commodity display board consists of a flat board main body having a predetermined surface area necessary to display commodities. Due to this, the board main body can be used as the base plate, the back plate, the inclined plate or the like of a cooling case, a wagon or the like to display commodities. Thus, the flexibility of the board main body enhances and the commodity display board can be applied to various modes of use in accordance with the manner in which the commodities are displayed.

Further, according to the present invention, engagement holes are formed on the entire top surface of the board main body at predetermined intervals. Due to this, partition plates or rolling stopper plates can be attached to the board main body using the engagement holes. As a result, the top surface of the board main body can be partitioned in accordance with displayed commodities, the board main body can be changed to various modes of use in accordance with the manner in which the commodities are displayed and the good air permeability of the board main body per se can be ensured.

Moreover, according to the present invention, the engagement holes are formed out of slit-like holes or slit-like grooves and the engagement holes are formed to be gradually enlarged from the top surface of the board main body toward the rear surface thereof. Thus, it is possible to prevent the engagement holes from getting clogged with dust and to easily clean the engagement holes.

Additionally, according to the present invention, adjacent board main bodies are coupled to each other using the coupling mechanisms of the board main bodies. Thus, the area of the commodity display board can be increased longitudinally and laterally, accordingly, the area of the commodity display board can be changed in accordance with the manner in which the commodities are displayed.

DETAILED DESCRIPTION OF THE INVENTION

The embodiments of the present invention will be described hereinafter with reference to FIGS. 1 to 16.

Figure 1:
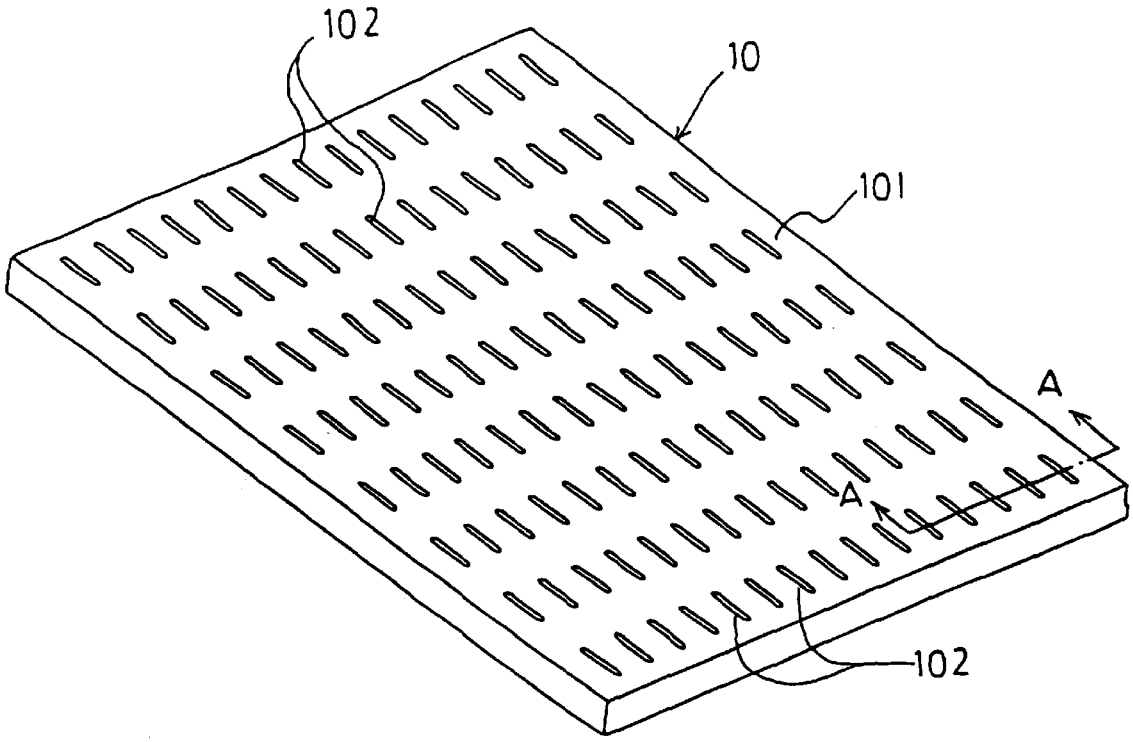
FIG. 1 is a perspective view of a commodity display board in the first embodiment according to the present invention.

First, the first embodiment of the present invention will be described with reference to FIGS. 1 to 6. In FIG. 1, a commodity display board 10 comprises a rectangular, flat synthetic resin board main body 101 having a predetermined surface area necessary to display commodities. In the main body 101, many slit-like engagement holes 102 each having a predetermined length are formed on the entire top surface of the board main body 101 in a matrix in the vertical and horizontal directions of the board main body 101 at predetermined intervals. These slit-like engagement holes 102 are constituted to impart an air permeability function to the board main body 101 and to allow display equipment 11 shown in FIGS. 2 to 4 to be detachably inserted into the holes 102.

Figure 2:
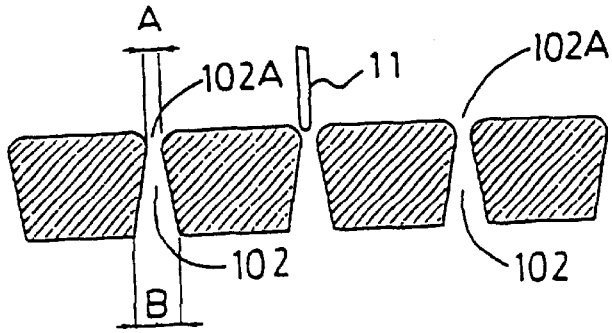
FIG. 2 is an enlarged sectional view taken along line A—A of FIG. 1 and showing one example of an engagement hole portion.

In addition, the slit-like engagement holes 102 are slit-like long holes constituted to be penetrated from the top surface (or front surface) of the board main body 101 to the rear surface thereof as shown in FIG. 2. In the slit-like engagement holes 102, the top surface-side openings 102A of the board main body 101 are formed at intervals A each corresponding to the thickness of a display equipment 11 and intervals B each gradually enlarged in a generally inverse V shape manner from the top surface-side opening 102A toward the rear surface of the board main body 101. By thus forming the slit-like engagement holes 102, it is possible to prevent dust from being collected or clogged in the engagement holes 102 and to easily clean the engagement holes 102.

Figure 3:
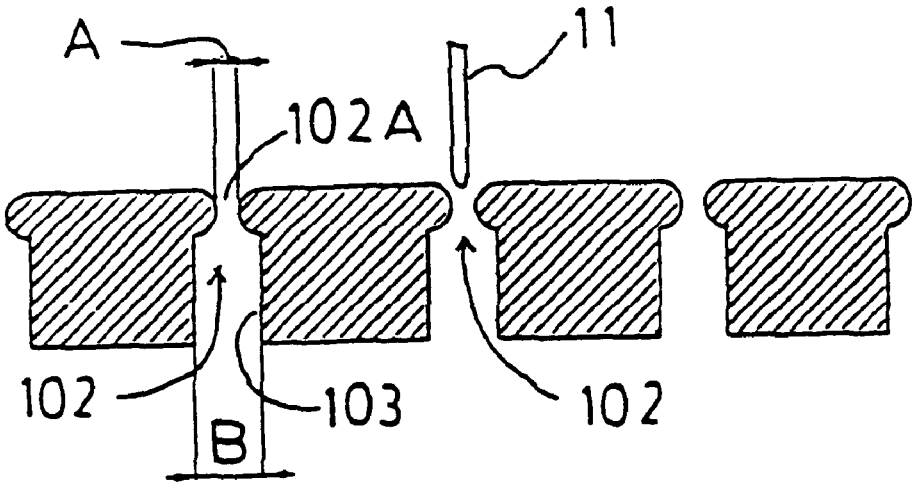
FIG 3 is an enlarged sectional view showing another example of an engagement hole portion according to the present invention.

FIG. 3 shows a modification of the slit-like engagement holes 102. In FIG. 3, the board main body top surface-side openings 102A of the slit-like engagement holes 102 are slit-like long holes formed at intervals A each corresponding to the thickness of the display equipment 11 and cavities 103 are formed at intervals B sufficiently wider than the intervals A of the top surface-side openings 102A on portions from the vicinity of the lower portions of the top surface-side openings 102A toward the rear surface of the board main body 101.

In this modification, the same function and advantage as those of the slit-like engagement holes 102 shown in FIG. 2 are obtained.

Figure 4:
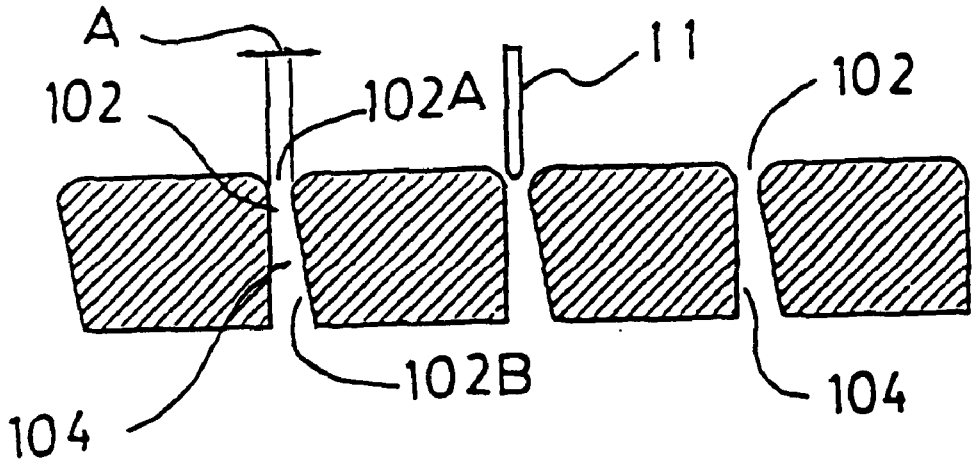
FIG. 4 is an enlarged sectional view showing yet another example of an engagement hole portion according to the present invention.

FIG. 4 is another modification of the slit-like engagement holes 102. In FIG. 4, the board main body top surface-side openings 102A of the slit-like engagement holes 102 are slit-like long holes formed at intervals A each corresponding to the thickness of the display equipment 11 and one of the side surfaces 102B opposite each other on a portion from the vicinity of the lower portion of each top surface-side opening 102A to the rear surface of the board main body 101 is cut obliquely to thereby form a cavity 104 larger in area than the top surface-side opening 102A.

In this another modification, the same function and advantage as those of the slit-like engagement holes 102 shown in FIG. 2 are obtained.

Figure 5:
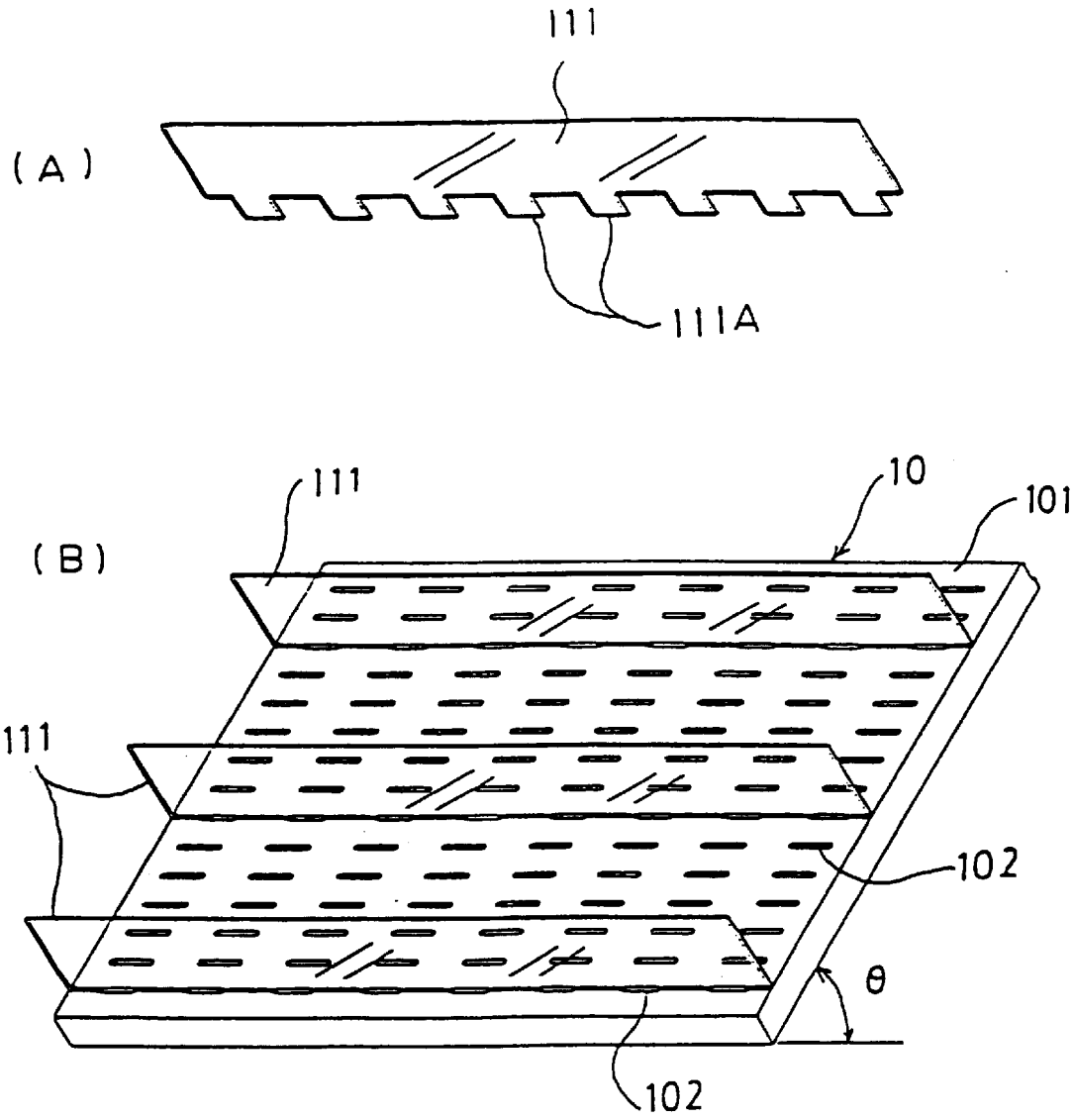
FIG. 5 is a perspective view showing display equipment showing an example as to how the commodity display board is used and showing a state in which the display equipment are assembled with a board main body in the first embodiment according to the present invention.

Next, an example as to how the commodity display board 10 in the first embodiment of the present invention is used will be described with reference to FIG. 5. The display equipment shown in FIG. 5(A) constitutes a strap-like rolling stopper 111 made of a transparent acrylic material or the like having a length corresponding to the longer length dimension of the board main body 101 shown in FIG. 5(B). Many engagement pieces 111A detachably inserted into the respective slit-like engagement holes 102 arranged in the longer length direction of the board main body 101 are formed on the lower edge of each rolling stopper plate 111 in the longer length direction of the rolling stopper plate 111 at the same intervals as those of the slit-like engagement holes 102.

The rolling stopper plate 111 is attached vertically to the board main body 101 by inserting the engagement pieces 111A into the respective slit-like engagement holes 102 arranged in the longer length direction of the board main body 101 as shown in FIG. 5(B).

If commodities such as vegetables and fruits are displayed on the commodity display board 10 while the board 10 is inclined at a predetermined angle θ with respect to a horizontal plane, a plurality of rolling stopper plates 111 are attached to the board main body 101 at predetermined intervals and the commodities are put on the board main body 101 located on the upper surface sides of the rolling stopper plates 111 as shown in FIG. 5(B). By doing so, it is possible to display the commodities on the inclined commodity display board 10 without dropping the commodities. In this case, commodities can be displayed with apparently increased volume.

Figure 6:
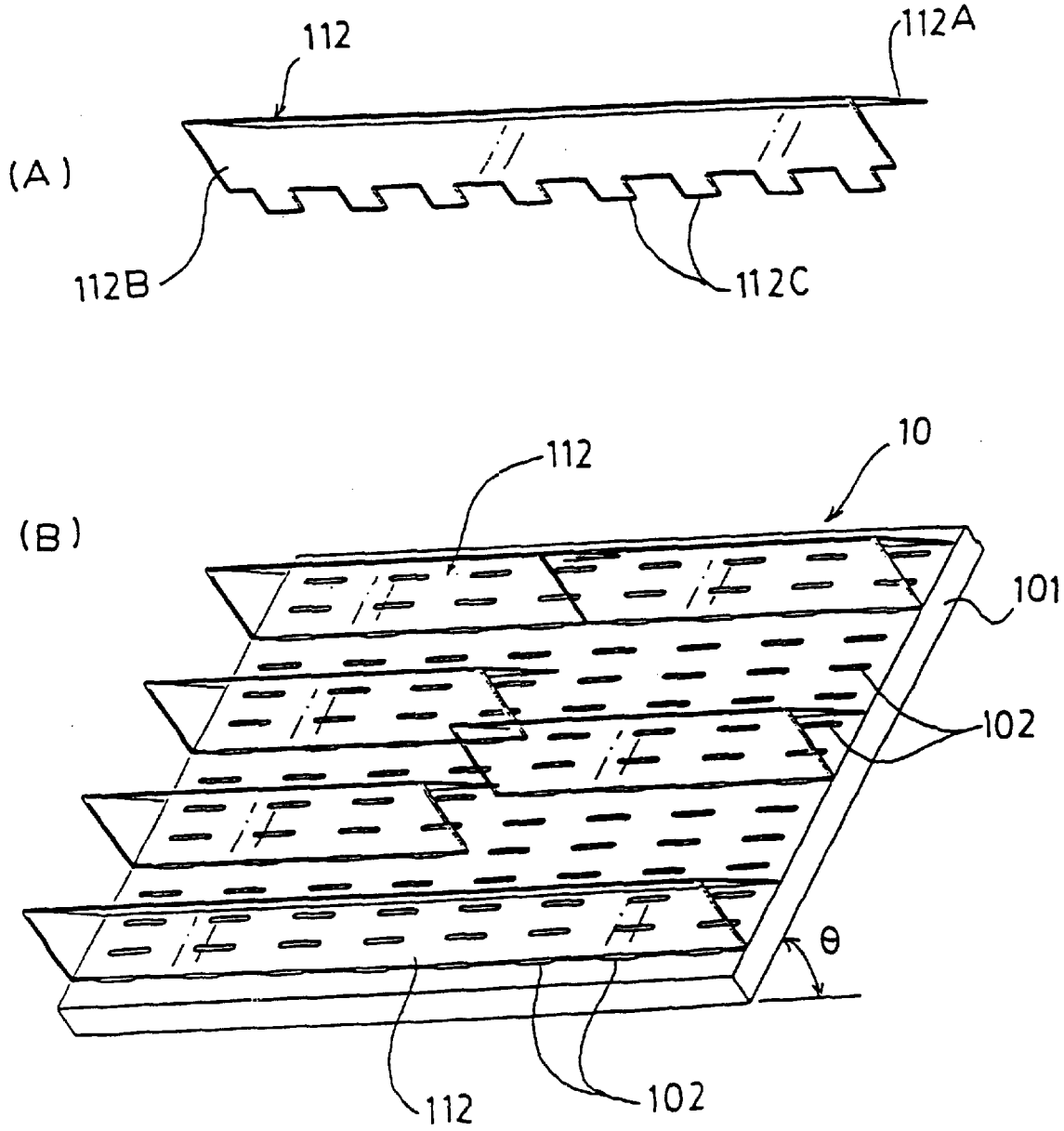
FIG. 6 is a perspective view showing display equipment showing another example as to how the commodity display board is used and showing a state in which the display equipment are assembled with the board main body in the first embodiment according to the present invention.

Next, another example as to how the commodity display board 10 in the first embodiment of the present invention is used will be described with reference to FIG. 6. The commodity equipment shown in FIG. 6(A) constitutes a rolling stopper plate 112 made of a transparent acrylic material or the like having a length corresponding to the longer length dimension of the board main body 101 shown in FIG. 6(B) or a length corresponding to half the longer length dimension of the board main body 101. The rolling stopper plate 112 is bent into a generally V shape to thereby form a horizontal commodity mounting piece 112A and a support piece 112B. Many engagement pieces 112C detachably inserted into the respective slit-like engagement holes 102 arranged in the longer length direction of the board main body 101 are formed on the lower edge of the support piece 112B in the longer length direction of the rolling stopper plate 112 at the same intervals as those of the slit-like engagement holes 102.

The rolling stopper plate 112 is attached to the board main body 101 as shown in FIG. 6(B) by inserting the engagement pieces 112C into the respective slit-like engagement holes 102 arranged in the longer length direction of the board main body 101. At this moment, the lower edge of the commodity mounting piece 112A is held to come in contact with the top surface of the board main body 101. If commodities such as vegetables and fruits are displayed on the commodity display board 10 while the board 10 is inclined at a predetermine angle θ with respect to a horizontal plane, the long rolling stopper plates 112 are attached to the lowest end portion of the board main body 101, the board main body 101 is halved laterally and a plurality of short rolling stopper plates 112 are attached to the respective halved regions of the board main body 101 in parallel at predetermined intervals corresponding to the sizes of the displayed commodities as shown in FIG. 6(B). By doing so, the top surface of the board main body 101 is partitioned into a plurality of regions and the commodity mounting pieces 112A of the respective rolling stopper plates 112 are held horizontally. In this state, if the commodities are put on the upper surfaces of the commodity mounting pieces 112A of the respective rolling stopper plates 112, the commodities can be displayed on the inclined commodity display board 10 without dropping the commodities. In this case, the commodities can be displayed with apparently increased volume and different types of commodities can be displayed in order on the same commodity display board 10.

Figure 7:
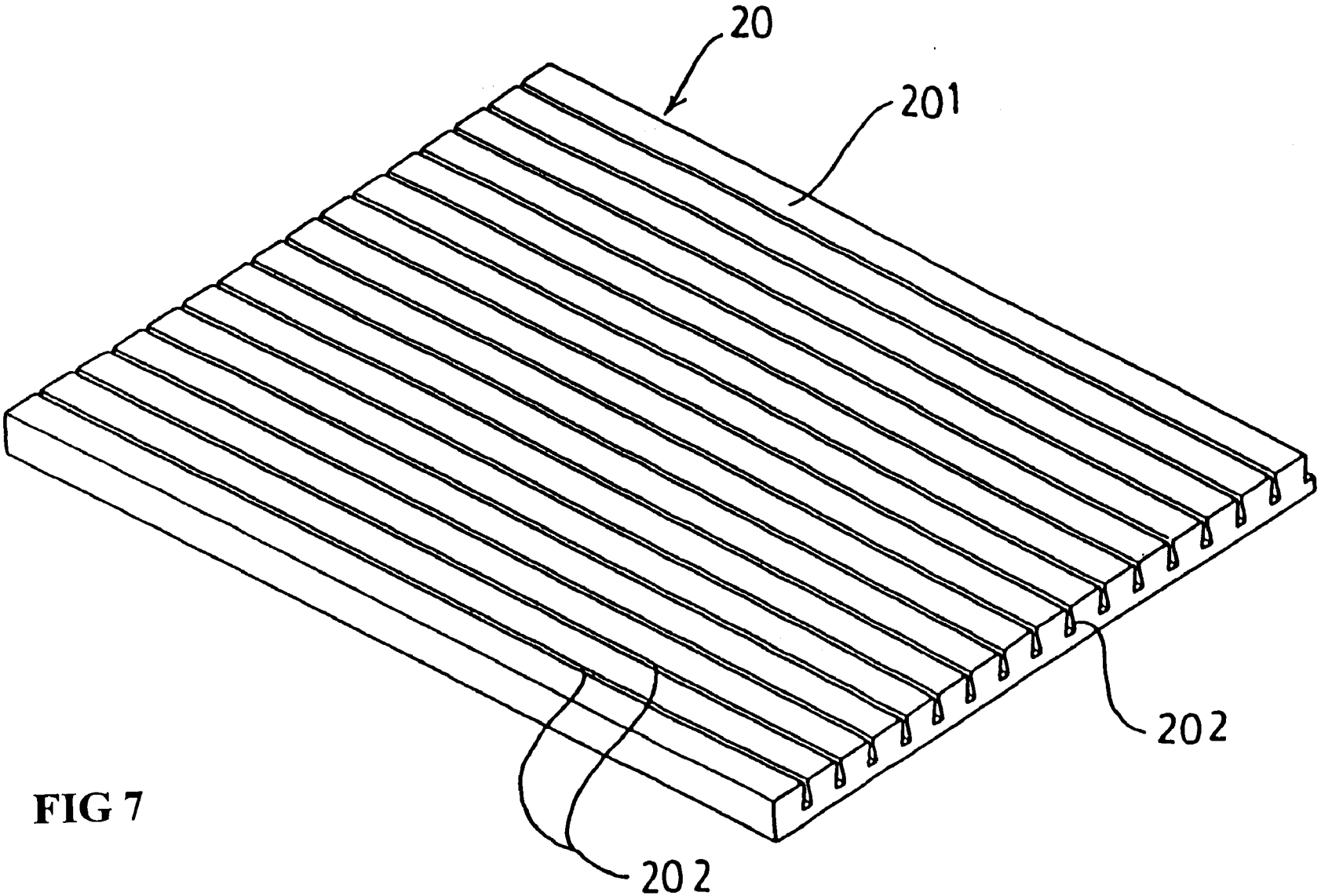
FIG. 7 is a perspective view of a commodity display board in the second embodiment according to the present invention.

Next, the second embodiment of the present invention will be described with reference to FIGS. 7 to 13. In FIG. 7, a commodity display board 20 comprises a rectangular, flat synthetic resin board main body 201 having a predetermined surface area necessary to display commodities. Many engagement holes 202 of slit-like grooves extending over the entire longer length of the board main body 201 are formed in parallel to one another at predetermined intervals in the shorter length direction of the board main body 201. The engagement holes 202 of slit-like grooves are constituted to impart air permeability to the board main body 201 and to allow the commodity equipment 21 shown in FIG. 10 to be detachably inserted into the engagement holes 202.

Figure 8:
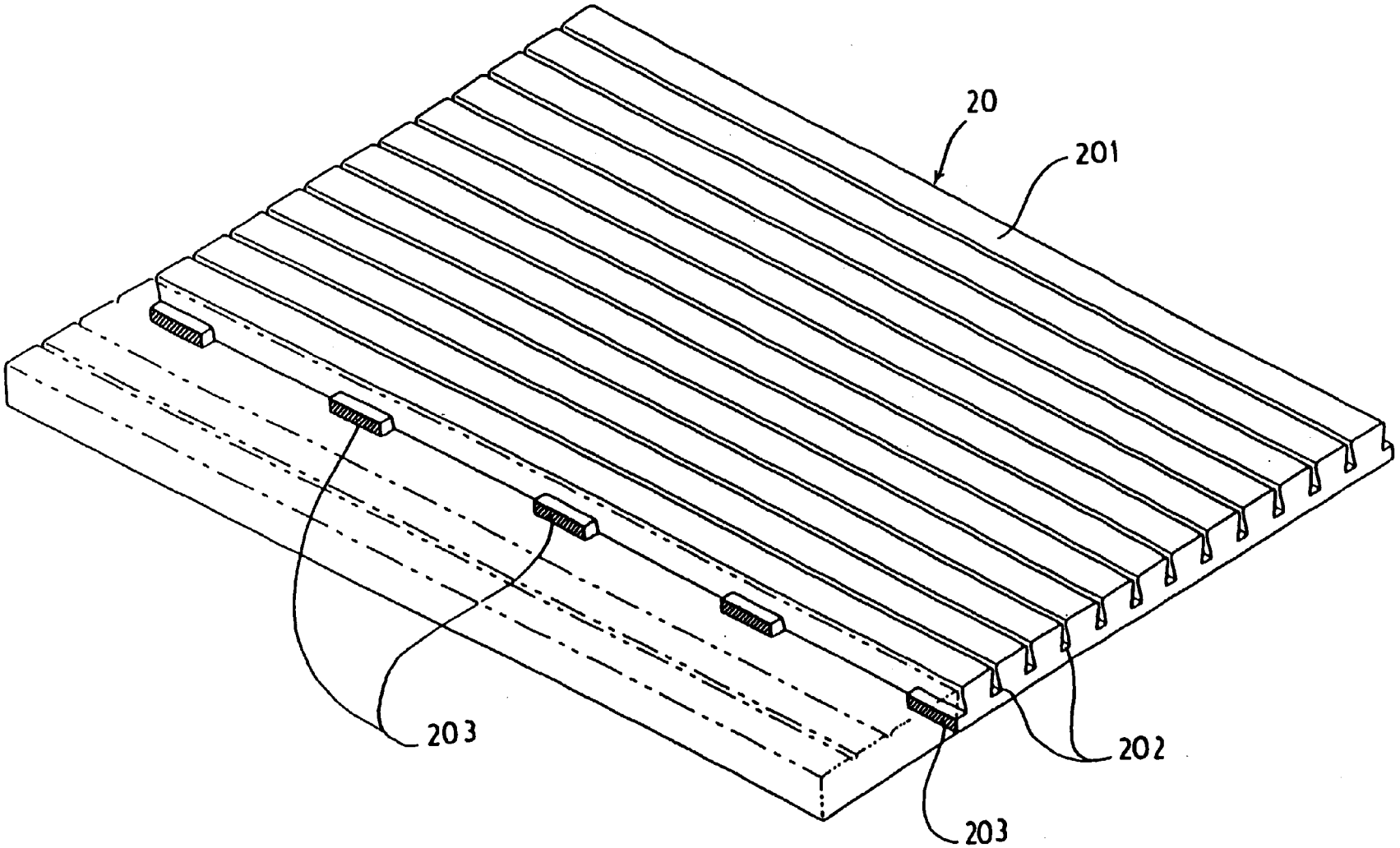
FIG. 8 is a perspective view of the partially notched commodity display board in the second embodiment according to the present invention.
Figure 9:
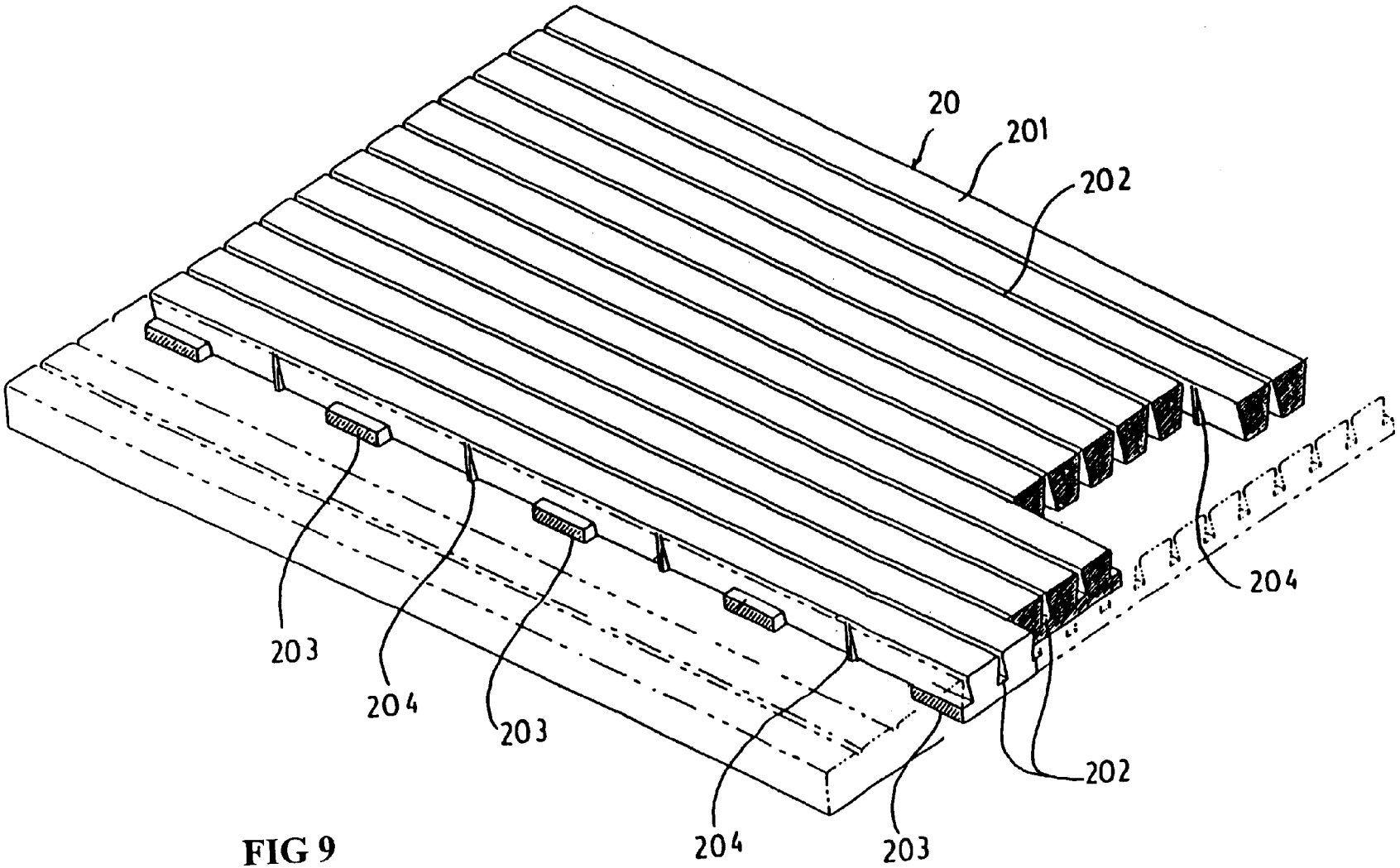
FIG. 9 is a partially notched, perspective view showing a modification of the commodity display board in the second embodiment according to the present invention.
Figure 10:
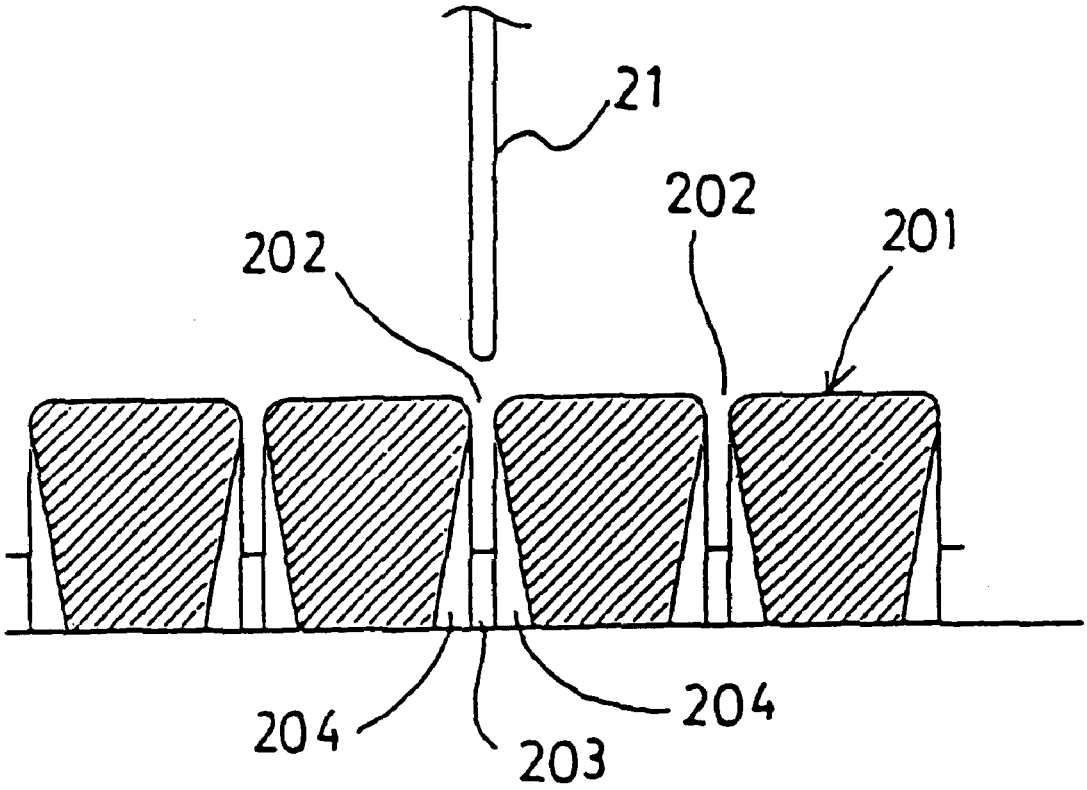
FIG. 10 is an enlarged sectional view showing the important parts of FIG. 9.

Also, the width of each engagement hole 202 formed out of a slit-like groove is gradually increased from the top surface of the board main body 201 toward the rear surface thereof. As shown in FIG. 8, the bottom of the engagement hole 202 formed out of a slit-like groove is opened to the rear surface of the board main body 201 while being partially left as coupling portions 203. By thus forming the engagement holes 202, it is possible to prevent dust from being collected and clogged in the engagement holes 202 and to easily clean the engagement holes 202. Further, as shown in FIGS. 9 and 10, ribs 204 guiding the commodity equipment 21 inserted into the respective engagement holes 202 are formed on the opposite inner wall surfaces of the engagement holes 202 formed out of slit-like grooves and located between the coupling portions 203.

Figure 11:
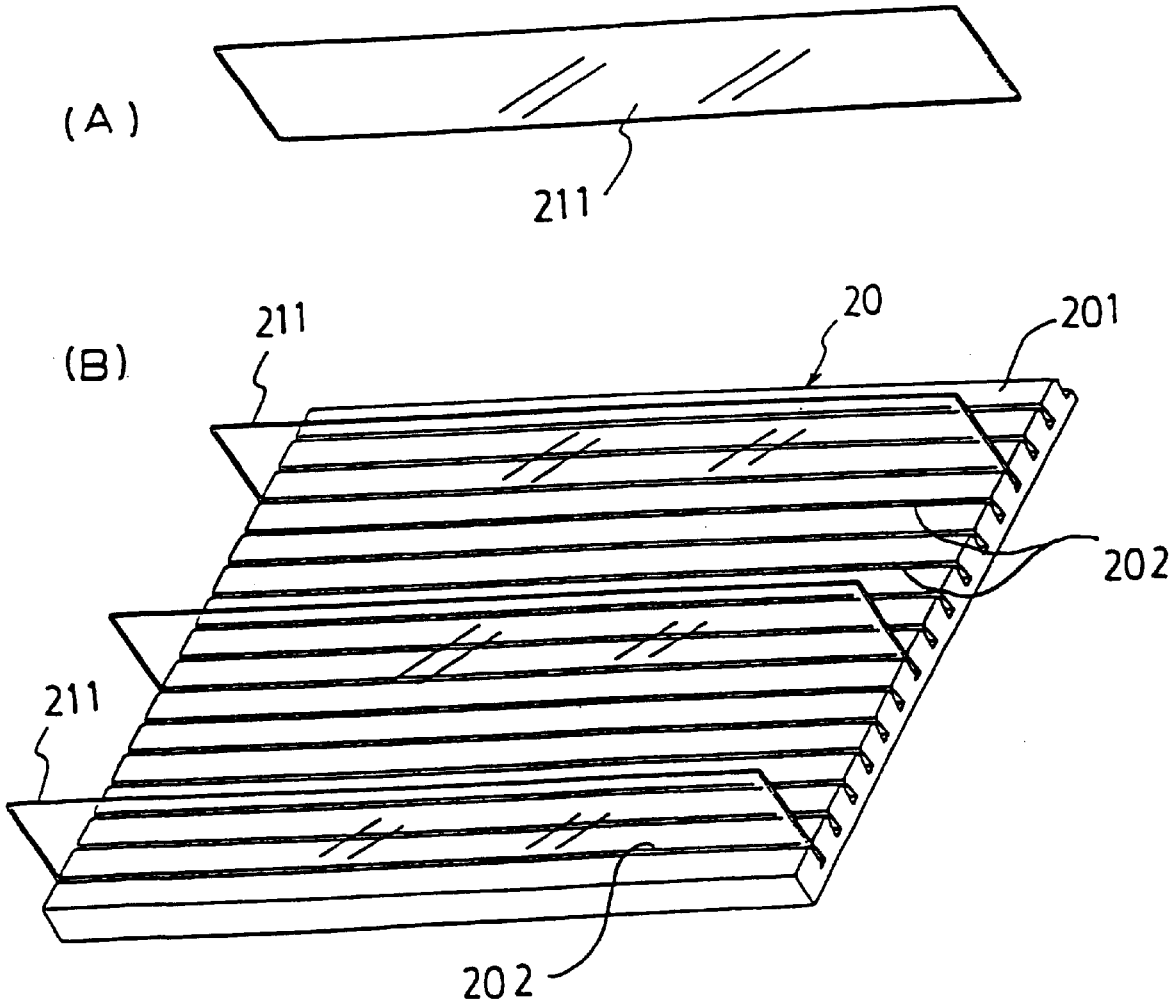
FIG. 11 is a perspective view showing display equipment showing an example as to how the commodity display board is used and showing a state in which the display equipment are assembled with a board main body in the second embodiment according to the present invention.

Next, an example as to how the commodity display board 20 in the second embodiment of the present invention is used will be described with reference to FIG. 11. The commodity equipment shown in FIG. 11(A) constitutes a strap-like rolling stopper plate 211 made of a transparent acrylic material or the like having a length corresponding to the longer length dimension of the board main body 201 shown in FIG. 11(B). By inserting the lower edges of the rolling stopper plates 211 into the respective engagement boles 202 each formed out of a slit-like groove, the rolling stopper plates 211 are vertically attached to the board main body 201 as shown in FIG. 11(B). If commodities such as vegetables and fruits are displayed on the commodity display board 20 while inclining the commodity display board 20 at a predetermined angle θ with respect to a horizontal plane, a plurality of rolling stopper plates 211 are attached to the board main body 201 at predetermined intervals and the commodities are put on the board main body 201 located on the upper surface sides of the respective rolling stopper plates 211. By doing so it is possible to display the commodities on the inclined commodity display board 20 without dropping the commodities. In this case, the commodities can be displayed with apparently increased volume.

Figure 12:
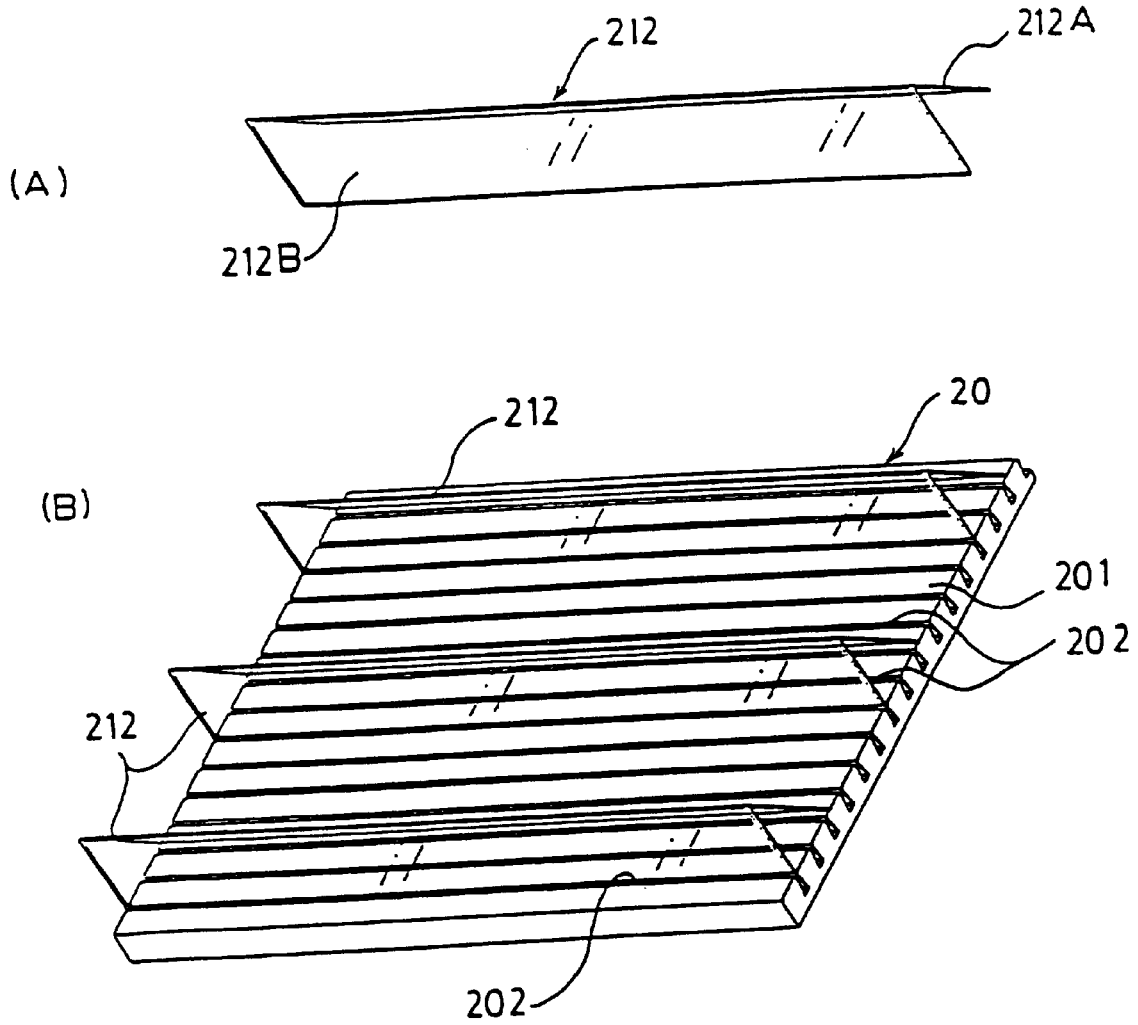
FIG. 12 is a perspective view showing display equipment showing another example as to how the commodity display board is used and showing a state in which the display equipment are assembled with the board main body in the second embodiment according to the present invention.

Next, another example as to how the commodity display board 20 in the second embodiment of the present invention is used will be described with reference to FIG. 12. The commodity equipment shown in FIG. 12(A) constitutes a rolling stopper plate 212 made of a transparent acrylic material or the like having a length corresponding to the longer length or half the longer length of the board main body 201 shown in FIG. 12(B). The rolling stopper plate 212 is bent into a generally V shape to thereby form a horizontal commodity mounting piece 212A and a support piece 212B.

The rolling stopper plates 212 constituted as stated above are attached to the board main body 201 as shown in FIG.

12(B) by inserting the lower edge portions of the support pieces 212B into the respective engagement holes 202 formed out of slit-like grooves and arranged in the longer length direction of the board main body 201. At this moment, the lower edges of the commodity mounting pieces 212A are held to come in contact with the top surface of the board main body 201. If commodities such as vegetables and fruits are displayed on the commodity display board 210 while inclining the commodity display board 210 at a predetermined angle θ with respect to a horizontal plane, a plurality of rolling stopper plates 212 are attached to the board main body 201 at predetermined intervals as shown in FIG. 12(B). At this moment, the commodity mounting pieces 212A of the respective rolling stopper plates 212 are held horizontally. In this state, the commodities are mounted on the upper surfaces of the commodity mounting pieces 212A of the respective rolling stopper plates 212. By doing so, the commodities can be displayed on the inclined commodity display board 20 without dropping the commodities. In this case, the commodities can be displayed with apparently increased volume.

Figure 13:
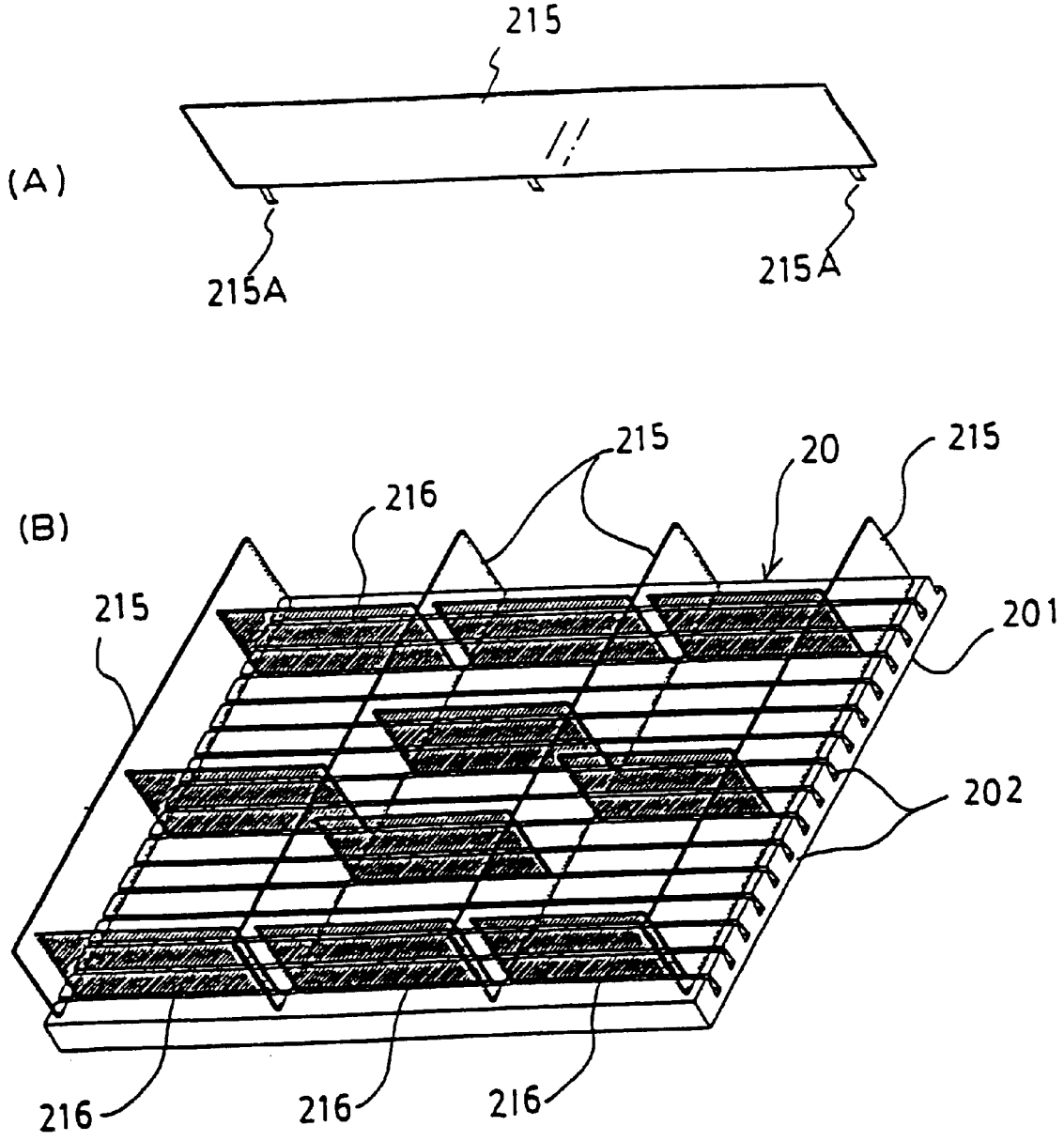
FIG. 13 is a perspective view showing display equipment showing yet another example as to how the commodity display board is used and showing a state in which the display equipment are assembled with the board main body in the second embodiment according to the present invention.

Next, yet another example as to how the commodity display board 20 in the second embodiment of the present invention is used will be describe with reference to FIG. 13. The commodity equipment shown in FIG. 13(A) constitutes a longitudinal partition plate 215 made of a transparent acrylic material or the like having a length corresponding to the shorter length dimension of the board main body 201 shown in FIG. 13(B). Protrusions 215A engaged with the respective engagement holes 202 of the board main body 201 are formed on the lower edge of the longitudinal partition plate 215. Also, in FIG. 13(B), the display equipment each having a length corresponding to one-third or less of the longitudinal dimension of the board main body 201 constitute lateral partition plates 216 each made of a transparent acrylic material or the like.

If the commodity display regions of the board main body 201 are partitioned according to the types of commodities using such longitudinal partition plates 215 and lateral partition plates 216, the longitudinal partition plates 215 are arranged to extend in the shorter length direction of the board main body 201 on the both end portions of the board main body 201 in the longer length direction and on portions on which the top surface of the board main body 201 is trisected in the longer length direction, and the protrusions 215A of the longitudinal partition plates 215 are inserted into the respective engagement holes 212, respectively, thereby attaching the longitudinal partition plates 215 to the board main body 201 as shown in, for example, FIG. 13(B). A plurality of lateral partition platen 216 are attached to the respective regions of the board main body 201 partitioned by the longitudinal partition plates 215, in parallel with one another at predetermined intervals each corresponding to the size of the displayed commodity. By doing so, the top surface of the board main body 201 is partitioned into plural commodity-display regions. In this state, the commodities are put in the commodity display regions partitioned by the lateral partition plates 216 and the longitudinal partition plates 215, respectively. By doing so, the commodities can be displayed on the inclined commodity display board 20 without dropping the commodities. In this case, the commodities can be displayed with apparently increased volume and different types of commodities can be displayed in order on the same commodity display board 20.

Figure 14:
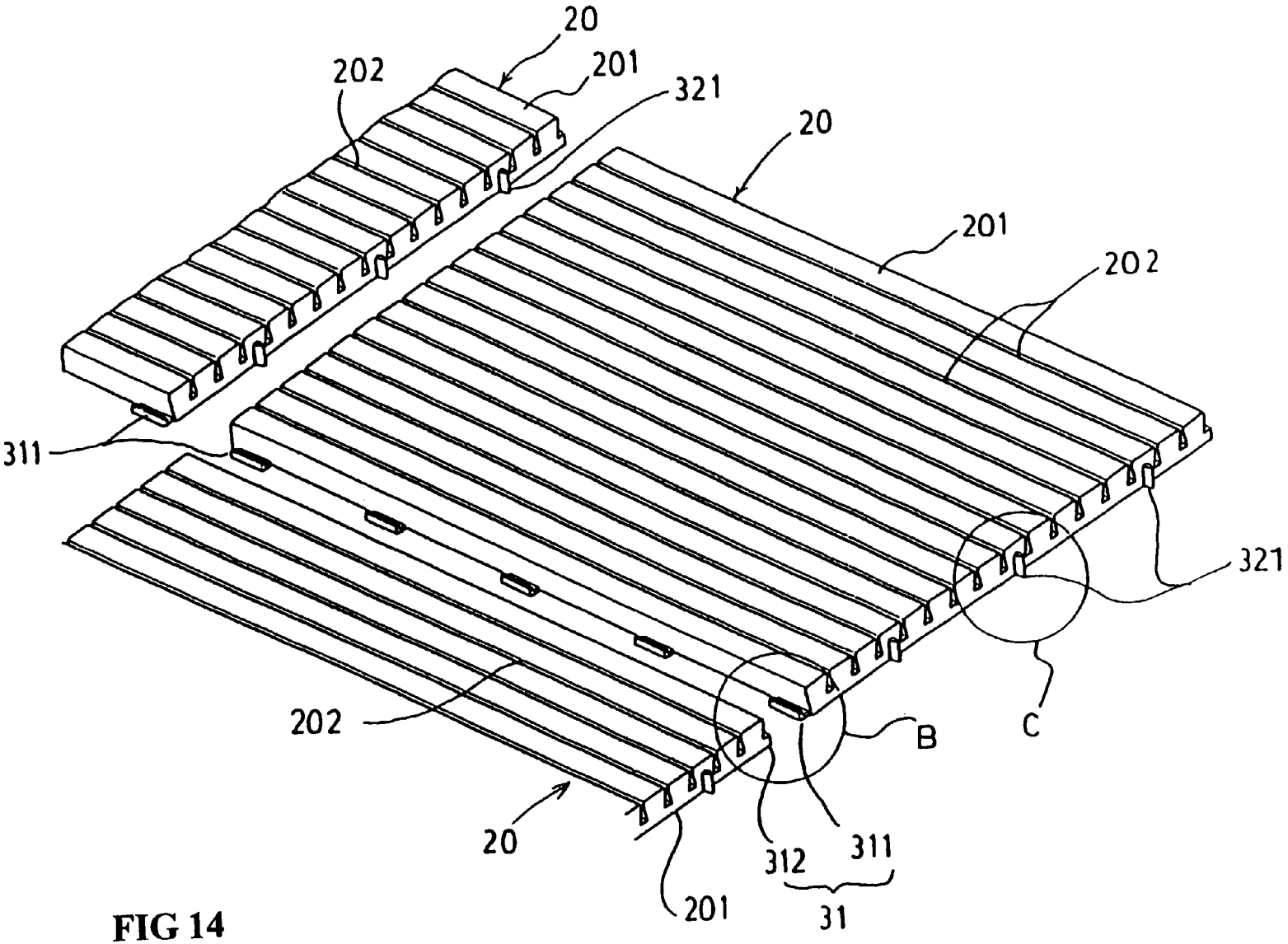
FIG. 14 is a perspective view of a commodity display board in the third embodiment according to the present invention.
Figure 15:
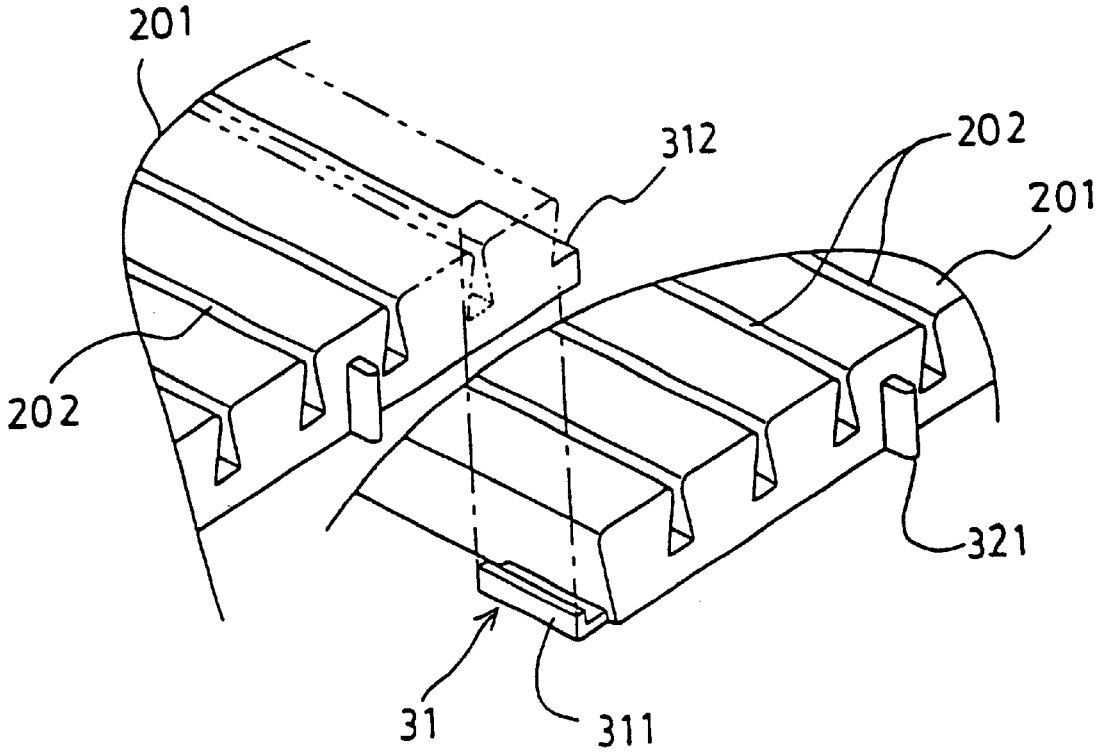
FIG. 15 is an enlarged perspective view of a coupling mechanism on a portion B of FIG. 14.
Figure 16:
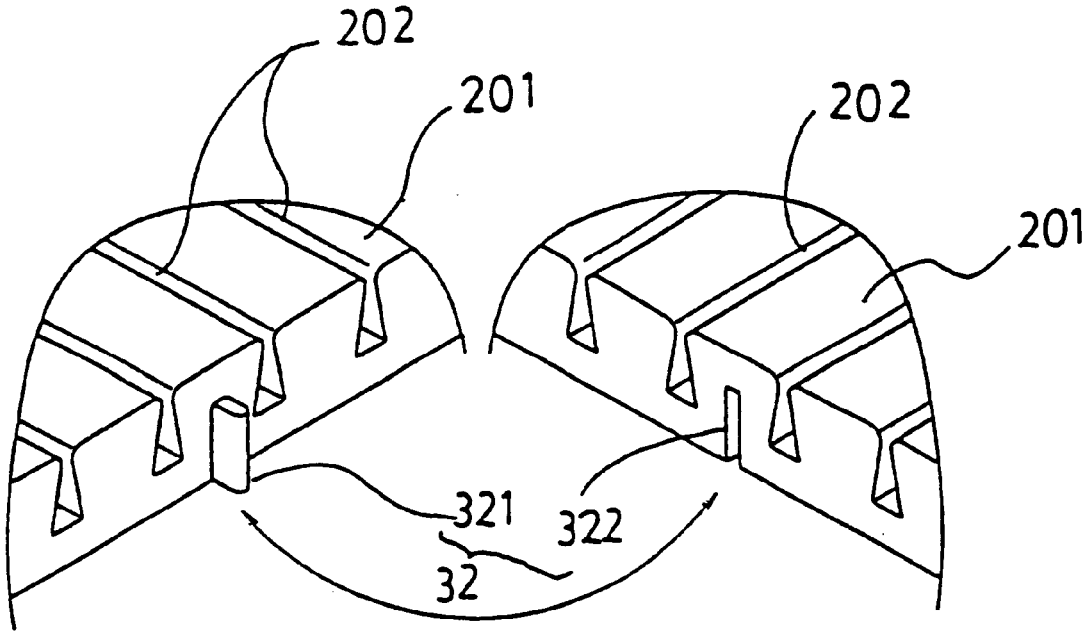
FIG. 16 is an enlarged perspective view of a coupling portion on a portion C of FIG. 14.

Next a commodity display board in the third embodiment of the present invention will be described with reference to FIGS. 14 to 16. FIG. 14 is a perspective view of the commodity display board in the third embodiment of the present invention. FIG. 15 is an enlarged perspective view of a coupling mechanism on a portion B of FIG. 14. FIG. 16 is an enlarged perspective view of a coupling mechanism on a portion C of FIG. 14. In FIG. 14, coupling mechanisms 31 and 32 coupling the adjacent board main bodies 201 so that the top surfaces thereof are flush with each other, are provided on the both ends of the board main body 201 in the longer length direction (i.e., lateral direction) and the both ends thereof in the shorter length direction (i.e., longitudinal direction), respectively.

The coupling mechanism 31 couples the adjacent board main bodies 201 in the shorter length direction (i.e., longitudinal direction). As shown in FIG. 15, the coupling mechanism 31 consists of a plurality of L-shaped engagement portions 311 provided on one end face of the board main body 201 in the shorter length direction at predetermined intervals in the longer length direction of the board main body 201 and a plurality of inverse L-shaped engagement portions 312 provided on the other end face of the board main body 201 in the shorter length direction at predetermined intervals in the longer length direction of the board main body 201. By engaging the inverse L-shaped engagement portions 311 of the adjacent board main body 201 with the L-shaped engagement portions 312 of the board main body 201, respectively, the adjacent two board main bodies 201 can be coupled to each other while the top surfaces thereof are coincident with each other. Further, the coupling mechanism 32 couples the adjacent board main bodies 201 in the longer length direction (i.e., lateral direction). As shown in FIG. 16, the coupling mechanism 32 consists of a plurality of convex portions 321 provided on one end face of the board main body 201 in the longer length direction at predetermined intervals in the shorter length direction of the board main body 201 and a plurality of concave portions 322 provided on the other end face of the board main body 201 in the longer length direction at predetermined intervals in the shorter length direction of the board main body 201. By engaging the convex portions 321 of the board main body 201 with the concave portions 322 of the adjacent board main body 201, respectively , the two adjacent board main bodies 201 can be coupled to each other while the top surfaces thereof are coincident with each other.

According to the third embodiment of the present invention as described above, by coupling the adjacent board main bodies 201 using the coupling mechanisms 31 and 32, the area of the commodity display board can be increased in longitudinal and lateral directions. Accordingly, the area of the commodity display board can be changed in accordance with the manner in which commodities are displayed.

In the first embodiment, description has been given to a case where no guide ribs are provided on the inner walls of the engagement holes 102. The present invention should not be limited to this embodiment and guide ribs may be provided on the inner walls of the engagement holes 102.

Further, according to the present invention, the coupling mechanisms in the third embodiment may be provided on the commodity display board 10 in the first embodiment.

Moreover, the modes of using the commodity display board 10 or 20 according to the present invention should not be limited to the examples shown in FIGS. 5 and 6 and FIGS. 11 to 13, respectively. The commodity display board 10 or 20 can be applied to commodity display base plate of a wagon or the like and to the back plate for the displayed commodities.

Additionally, the engagement holes 102 or 202 for attaching the display equipment according to the present invention should not be limited to slit-like holes or slit-like grooves as described in the embodiments. If the display equipment such as rolling stoppers and partitions are made of metallic wires, the engagement holes may be round holes, elliptic holes or the like.

Needless to say, the coupling mechanisms 31 and 32 according to the present invention should not be limited to those constituted as shown in FIGS. 14 to 16.

INDUSTRIAL APPLICABILITY

As stated so far, according to the present invention, the commodity display board consists of a flat board main body having a predetermined surface area necessary to display commodities. Due to this, the board main body can be used as the base plate, the back plate, the inclined plate or the like of a cooling case, a wagon or the like to display commodities. Thus, the flexibility of the board main body enhances and the commodity display board can be applied to various modes of use in accordance with the manner in which the commodities are displayed.

Further, according to the present invention, engagement holes are formed on the entire top surface of the board main body at predetermined intervals. Due to this, partition plates or rolling stopper plates can be attached to the board main body using the engagement holes. As a result, the top surface of the board main body can be partitioned in accordance with displayed commodities, the board main body can be changed to various modes of use in accordance with the manner in which the commodities are displayed and the good air permeability of the board main body per se can be ensured.

Moreover, according to the present invention, the engagement holes are formed out of slit-like holes or slit-like grooves and the engagement holes are formed to be gradually enlarged from the top surface of the board main body toward the rear surface thereof. Thus, it is possible to prevent the engagement holes from getting clogged with dust and to easily clean the engagement holes.

Additionally, according to the present invention, adjacent board main bodies are coupled to each other using the coupling mechanisms of the board main bodies. Thus, the area of the commodity display board can be increased longitudinally and laterally, accordingly, the area of the commodity display board can be changed in accordance with the manner in which the commodities are displayed.

What is claimed is:

1. A commodity display board for displaying commodities, comprising:

a flat board main body having a predetermined surface area necessary to display the commodities; and a plurality of engagement holes for attaching display equipment and permeating air formed on an entire region of a top surface of the board main body at predetermined intervals, wherein said engagement holes are formed out of slit-like grooves extending over an entire length of one edge of said board main body, and the slit-like grooves are arranged parallel to one another in large number at predetermined intervals in a direction of the other edge of said board main body, and wherein a width of each of said slit-like grooves is gradually increased from a top surface of said board main body toward a rear surface of the board main body, and a bottom of each of said slit-like grooves is opened to the rear surface while being partially left.

2. A commodity display board according to claim 1, further comprising:

a rib guiding said display equipment formed on one of an inner wall surface of each of said slit-like engagement holes and an inner wall surface of each of said slit-like grooves.

* * * * *